United States Patent [19]

McConnell

[11] Patent Number: 4,702,465

[45] Date of Patent: Oct. 27, 1987

[54] UNIVERSAL EXTREMITY POSITIONER

[76] Inventor: Bernard E. McConnell, Rte. 2, Box 87, Greenville, Tex. 75401

[21] Appl. No.: 794,388

[22] Filed: Nov. 4, 1985

Related U.S. Application Data

[63] Continuation-in-part of Ser. No. 598,579, Apr. 10, 1984, Pat. No. 4,579,324, which is a continuation of Ser. No. 267,523, May 27, 1981, abandoned.

[51] Int. Cl.[4] ..... A61G 13/00

[52] U.S. Cl. ..... 269/328

[58] Field of Search ..... 403/90, 59, 385; 248/288.5, 286, 279; 128/84; 269/328, 75, 77, 78, 79, 81, 71

[56] References Cited

U.S. PATENT DOCUMENTS

| | | | |
|---|---|---|---|
| 420,969 | 2/1890 | Seaman | 269/75 |
| 1,981,253 | 11/1934 | Schulz | 269/75 |
| 2,776,152 | 1/1957 | Ianvzzi | 403/90 |
| 3,887,291 | 6/1975 | Langren | 403/385 |
| 3,902,817 | 9/1975 | Meir | 403/385 |
| 4,066,231 | 1/1978 | Bahner et al. | 248/288.3 |
| 4,070,011 | 1/1978 | Glesser | 269/75 |
| 4,140,413 | 2/1979 | Conrad | 403/90 |

FOREIGN PATENT DOCUMENTS

| | | | |
|---|---|---|---|
| 823556 | 9/1969 | Canada | 269/328 |
| 1086722 | 8/1954 | France | 403/385 |
| 1262696 | 4/1961 | France | 269/328 |

*Primary Examiner*—Robert C. Watson

*Attorney, Agent, or Firm*—Glaser, Griggs & Schwartz

[57] ABSTRACT

A positioning apparatus for use in surgical operating procedures and the like comprising a universal positioner which may be adjustably positioned along a support bar suspended from and substantially rigidly connected to an operating table or the like. The positioning apparatus includes a ball and circular jaw coupling including spaced apart clamp blocks having upper and lower clamp rings for forcibly engaging the ball in response to the urging of a plurality of compression springs. A lever actuated cam connected to a foot pedal is operable to release the biasing force on the support blocks whereby the position of the support arm connected at one end to the ball may be finely adjusted over a wide range of positions.

12 Claims, 8 Drawing Figures

UNIVERSAL EXTREMITY POSITIONER

CROSS-REFERENCE TO RELATED APPLICATION

This application is a continuation-in-part of pending U.S. application Ser. No. 598,579 filed Apr. 10, 1984, now U.S. Pat. No. 4,579,324 which is a continuation of U.S. application Ser. Number 267,523 filed May 27, 1981, now abandoned.

FIELD OF THE INVENTION

This invention relates generally to the art of clamping devices, and in particular to a clamp assembly for attaching surgical support and positioning apparatus onto an operating table.

BACKGROUND OF THE INVENTION

In the performance of orthopedic surgery and related procedures, it is often necessary to support a portion of the patient's body including one or more limbs in a fixed position during the procedure, and also to vary the position from time to time. In some cases, operating room personnel manually support the particular extremity and change the position of the extremity as desired. The use of operating room personnel to support a patient during a surgical procedure is unsatisfactory in that the assistant supporting the extremity may tire and find it necessary to change position at some critical or otherwise inconvenient time. Additionally, pillows and other padded devices have been used. Such devices may obstruct the performance of surgery or related procedures and usually cannot provide overhead support for slings, hooks and the like.

Accordingly, various mechanical devices have been constructed and utilized for supporting and positioning body portions including limbs during the performance of surgery on a portion of a limb itself or a connecting joint. Such mechanical devices are adapted for attachment to an operating table or a free standing platform and generally include surgical support apparatus overlying the sterile zone of the operating table. Such equipment may be clamped onto a side rail of the operating table and are moved about from time to time as required by the surgical procedure. Free standing support equipment is not in widespread use for orthopedic procedures because of the stability requirements of such procedures.

DESCRIPTION OF THE PRIOR ART

Operating tables are provided with side rails onto which surgical support equipment can be attached. However, the side rails are relatively small and are closely located to the sterile operating field. Certain support positions are difficult to achieve with support apparatus which is attached directly to the side rail. For example, the lower arm board is preferably mounted at table level and the lower element of certain hip positioning apparatus should also be supported near the surface of the operating table. Such support apparatus is preferably mounted in offset relation with respect to the operating table to provide for a wide range of support positions.

Moreover, certain universal positioning equipment must be manually released from time to time to reposition support devices such as slings and hooks which are suspended above the sterile operating zone. An example of such equipment is disclosed and claimed in my copending U.S. application Ser. No. 598,579, filed Apr. 10, 1984, entitled "Universal Extremity Positioner". In that arrangement, the universal positioning apparatus has a foot-operated release and is mounted onto a large support bar which is suspended from the side rail. In that arrangement, the position of a sling or hook mounted on the positioning apparatus can be changed at will by pressing and releasing the foot lever.

It will be appreciated that in surgical procedures, time is of the essence, and delays associated with adjustment of support equipment are unwanted. Additionally, during certain procedures, it is desirable to impose or change a biasing force on a body portion or limb which is undergoing a surgical procedure or treatment. It is awkward or impossible in some instances to apply such bias forces through instruments or apparatus which are mounted directly onto the side rail. Thus it is desirable to offset such equipment booth laterally and vertically in the regions immediately surrounding the operating table, and below the side rail areas.

Accordingly, there is a specific need for surgical support apparatus which may be mounted onto an operating table outside of the sterile field, for suspending a limb support device above the operating surface of the table, with the position of the limb supporting apparatus or the like being stable when set, and being easily and quickly adjustable to new support positions as desired.

SUMMARY OF THE INVENTION

The present invention provides a universal positioning apparatus for use in connection with an operating table or other support structure for supporting a patient during the performance of surgical procedures, and which is quickly and easily adjusted to a wide range of stable support positions.

The present invention also provides a positioning apparatus which is particularly adapted for attachment to standard surgical operating tables for supporting one or more parts of the patient's body during the performance of surgery and the like. In particular, the apparatus of the present invention includes one or more support arms which are adjustably mounted on an auxilliary support bar mounted below the operating table, with the arms being substantially adjustable over a wide range of positions and secured in a predetermined position for supporting a patient extremity and for tensioning or biasing a body portion of the patient as required during a particular surgical procedure.

In accordance with one important aspect of the present invention, a universal positioning apparatus is provided for adjustably supporting a patient and particularly, an extremity during surgery thereon, with the positioning apparatus being adjustable by the surgeon during a surgical procedure and wherein the surgeon's hands may remain free for performing the procedure or other tasks while the position of the support arm is being altered.

In accordance with another important aspect of the present invention, a universal positioning apparatus is particularly adapted for attachment to an elongated support bar mounted below the patient support surface of an operating table or the like and wherein a plurality of such universal positioning mechanisms may be provided, each supporting a positioning arm and associated extremity support apparatus.

The present invention provides an improved positioning apparatus for supporting a patient extremity during the performance of a surgical procedure or the like wherein portions of the apparatus disposed in the sterile zone in which the procedure is being performed may be easily removed from the remaining structure of the positioning mechanism for sterilization purposes. Moreover, the removable sections of the positioning apparatus support arms are adjustable and ordinarily are not exposed outside of the sterile zone.

The features and advantages of the present invention will be further appreciated by those skilled in the art upon reading the detailed description which follows in conjunction with the drawings.

DESCRIPTION OF THE PREFERRED EMBODIMENT

Figure 1:
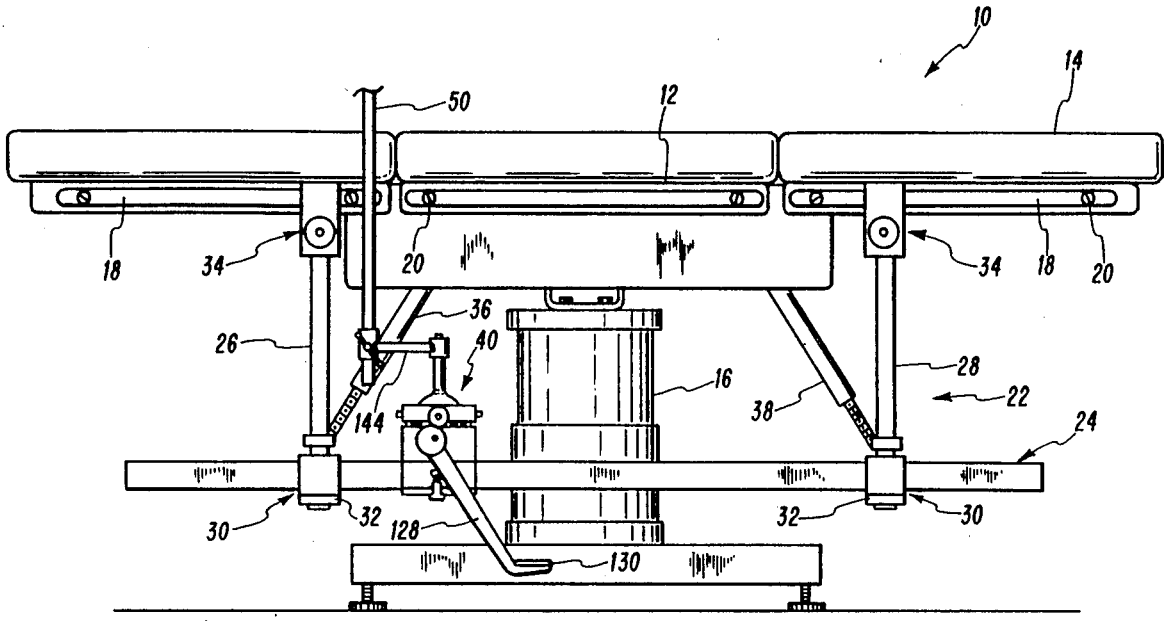
FIG. 1 is a side elevational view of the positioning apparatus of the present invention mounted on a surgical operating table.

In the description which follows, like parts are indicated throughout the specification and drawings with the same reference numerals, respectively. The drawings are not necessarily to scale and certain parts have been exaggerated to better illustrate details of the present invention.

The improved universal positioner of the present invention is particularly well-suited for use in combination with a conventional surgical operating table during the performance of orthopedic surgery or other surgical procedures.

Figure 2:
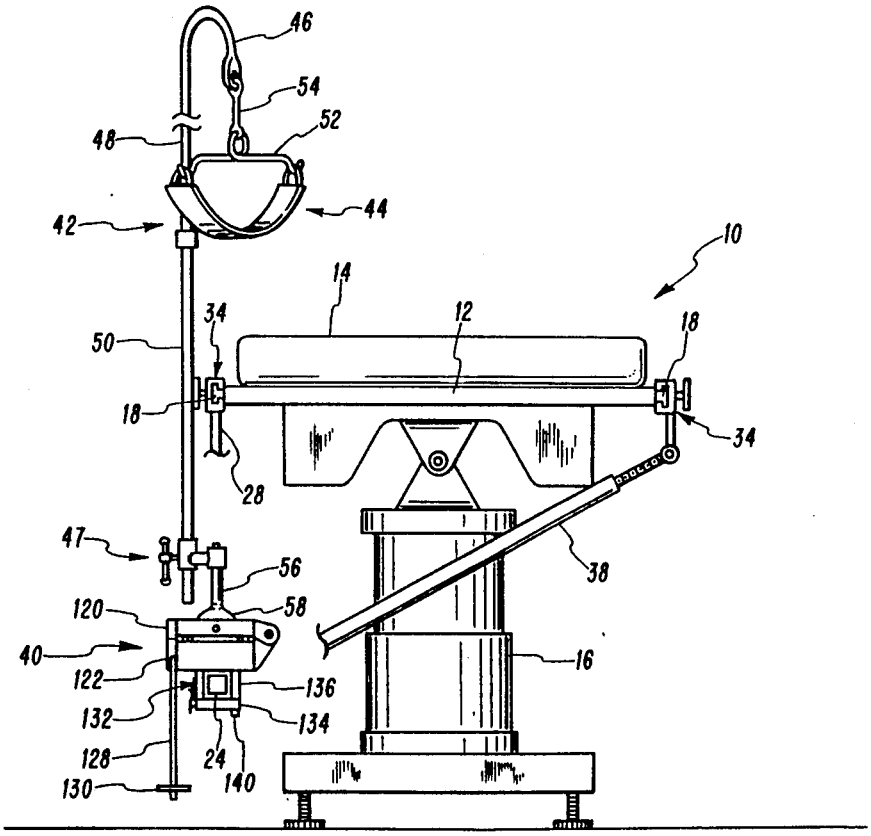
FIG. 2 is an end elevational view of the positioning apparatus mounted on the table as shown in FIG. 1.

Referring now to FIGS. 1 and 2 of the drawings, there is illustrated an operating table generally designated by the numeral 10 which includes a patient support table 12 and a sterile pad 14. The operating table 10 includes a base structure 16 which is capable of altering the position of the patient support table 12 to accommodate various surgical procedures. The table 10 also includes, along opposite longitudinal sides thereof, longitudinal support rails 18 which are rectangular in cross section and constructed of stainless steel. The side rails 18 appear as somewhat elongated flat metal bars which are mounted onto the table 12 and laterally spaced therefrom by pins 20.

Attached to the side rail 18 is a suspension assembly 22 having a horizontally disposed support bar 24. The support bar 24 is rectangular in cross section and may be solid or hollow, as desired. The support bar 24 is connected to a pair of vertical legs or struts 26, 28 the lower ends of which are clamped onto the support bar 24 by a removable clamp assembly 30. The clamp assembly 30 is a rectangular frame having a plate 32 which compresses the bar 24 thereby securely anchoring each of the legs 26, 28 firmly in place.

The vertical support struts 26, 28 are fastened onto the side rails 18 by a rail clamp assembly 34. The clamp assembly 34 is configured to slide along the rails 18 and to be secured in any desired rail location. The support bar 24 is further stabilized by a pair of transverse struts 36, 38. Each transverse strut extends from one of the lower support legs upwardly for connection to the opposite side rail 18 by a clamp assembly 34.

The support bar 24 when stabilized by the struts 36, 38 and by the support legs 26, 28 serves as a stable platform onto which auxiliary support equipment such as a universal extremity positioner 40 may be mounted in a manner to be described below.

In the performance of various surgical procedures, particularly in orthopedic surgery, it is necessary to support various portions of the body including its extremities in a suspended position while the procedure is performed. For example, a sling assembly 42 may be attached to the universal extremity positioner 40 and is adapted to support an arm or leg of a patient at an elevated position during a surgical procedure. During such a procedure, it may be necessary to move the extremity or to apply biasing forces in a particular direction. The suspension assembly 22 makes this possible because of the stability provided by the vertical struts 24, 26, transverse struts 36, 38 and the improved universal positioner assembly 40.

As will be appreciated from the foregoing description, the support structure 22 provides stable support for the positioning apparatus 40 of the present invention, which may be readily connected to standard operating tables and the like and which is movable with the table in roll, pitch and elevation thereof. Moreover, the support bar 24 may be longitudinally, as well as somewhat laterally adjusted with respect to the support surface of the table, and the legs 26, 28 may be adjusted to desired positions along the sides of the table 10. The struts 26, 28 and struts 36, 38 are adjustable in length to accomodate various rail locations of the clamps 30, 34.

In the performance of various surgical procedures, particularly in orthopedic surgery, it is necessary to support various portions of the body including extremities, such as arms or legs, in a suspended position while the procedure is being carried out. It is also often necessary to vary the position of the extremity or some other portion of the patient's body during the procedure. In this regard, the universal positioner 40 together with the sling apparatus 42 are provided for suspending a patient's leg or other extremity during a surgical procedure. The sling apparatus 42 includes a sling 44 movably coupled to a curved support arm 46. The curved support arm 46 includes a base portion 48 which is removably attached to a lower support shaft 50. Preferably, the base portion 48 of the support arm is slidably received within the lower support shaft 50 and which may be suitably clamped thereto in a selected one of various elevations and rotational positions, and may be removed for sterilization. By providing the upper base portion 48 as a member slidably received within the lower base portion 50, any vertical adjustment of the upper arm portion 48 will not result in movement of the arm portion outside of the sterile zone. Moreover, the upper arm portion 48 may be easily removed with the base portion 50 for sterilization purposes. The lower end of support tube 50 is closed, thereby preserving established sterile conditions.

Referring particularly to FIG. 2, the curved upper arm portion 46 is adapted to support a sling 42 by means of suitable hanger members, and may take various forms other than the specific form illustrated. The sling 42 is adapted, for example, to suspend an arm or leg of a patient while lying on the table 10 and undergoing a surgical procedure. As indicated previously herein, during the performance of various surgical procedures and treatment, it is necessary to move a portion of the patient extremity or apply biasing forces in one direction or another. In this regard, the sling assembly 42 is adapted to be positioned substantially universally with respect to the table 10 throughout a wide range of positions by the universal positioner 40. Moreover, the sling assembly 42 is removable for sterilization by releasing clamp 47 and withdrawing lower support shaft 50.

Referring now to FIGS. 3–8, the universal positioner 40 will now be described. It will be appreciated from the description herein that one or more of the universal positioners 40 together with a sling assembly 42 or other such patient supporting apparatus may be positioned along the bar 24 as desired. The positioning apparatus 40 includes an erect support shaft 56 which is fixed at its lower end to a generally spherical bearing member 58. The bearing member 58 is received within a bearing chamber 60 formed within a lower clamp block 62 and an upper clamp block 64. The lower clamp block 62 is provided with a cylindrical bore 66 and the upper clamp block 64 is provided with a cylindrical bore 68. The upper clamp block 64 is pivotedly coupled to the lower block 62 by a pivot pin 70. The pivot pin 70 couples lower hinge plates 72, 74, which are attached to the lower clamp block 62, to upper upper hinge plate 76, 78 which are attached to the upper clamp block 64. According to this arrangement, the upper clamp block 64 is rotatable about the axis 80 with respect to the lower clamp block 64. That is, the upper clamp block 64 is rotatable outwardly to open the bearing chamber 60 to admit the spherical bearing member 58.

The bore 66 of the lower clamp block 62 together with the bore 68 of the upper clamp block define the bearing chamber 60. The spherical bearing member 58 is gripped and suspended within the bearing chamber 60 by a lower bearing ring 82 and an upper bearing ring 84. The lower clamp block 62 is provided with a cylindrical counterbore 86 within which the lower bearing ring 82 is received. Similarly, the upper clamp block 64 is provided with a cylindrical counterbore 88 within which the upper bearing ring 84 is received. The inside diameter of each bearing ring is slightly less than the diameter of the spherical bearing member. According to this arrangement, the spherical bearing member 58 is engaged in a circular, line contact along the inside edge 90 of the lower bearing ring 82. Similarly, the spherical bearing member 58 is engaged in a circular, line contact along the inside edge 92 of the upper bearing ring 84.

According to the preferred embodiment, the lower bearing ring 82 is rotatable within the cylindrical counter bore 86. The annular bearing ring 82 is provided with an annular notch 94 in which a retaining pin 96 is received. The purpose of the retaining pin 96 is to limit the axial displacement of the lower bearing ring while allowing the lower bearing ring to turn freely within the cylindrical counter bore 86. This allows the spherical bearing member 58 to "break away" from the grip of the lower bearing ring without dislodging the lower bearing ring from the cylindrical counterbore 86. The retaining pin 96 is received within a threaded bore in the lower clamp block 62, and projects radially into the annular notch 94, preferably without engaging or otherwise binding the bearing ring 82.

Figure 5:
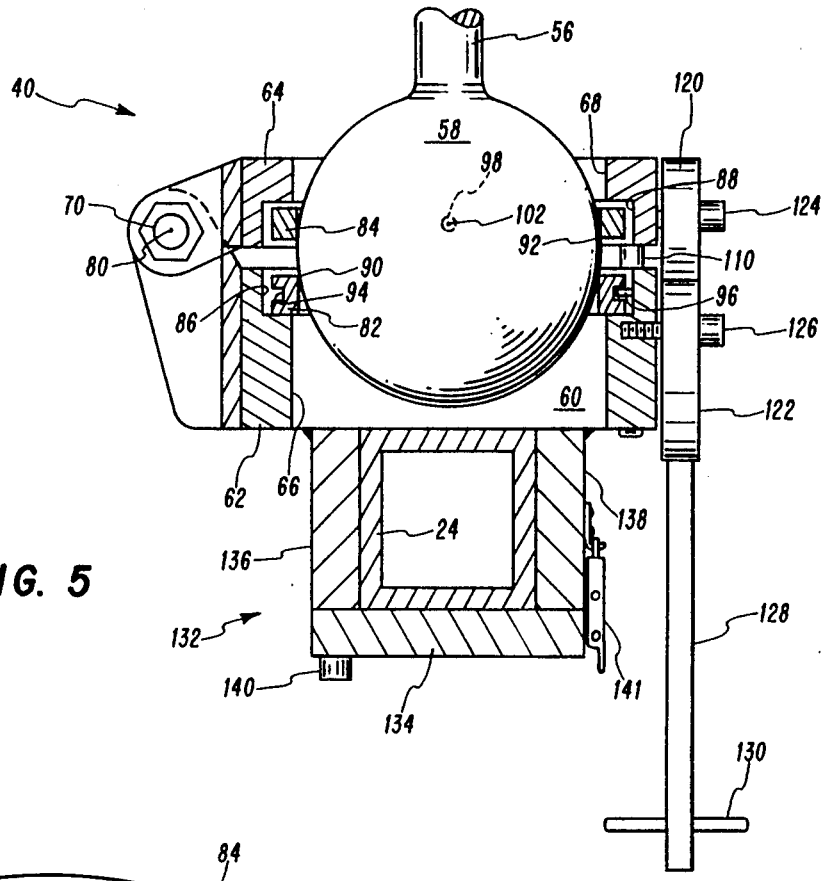
FIG. 5 is a sectional view taken substantially along the line V—V of FIG. 4.
Figure 6:
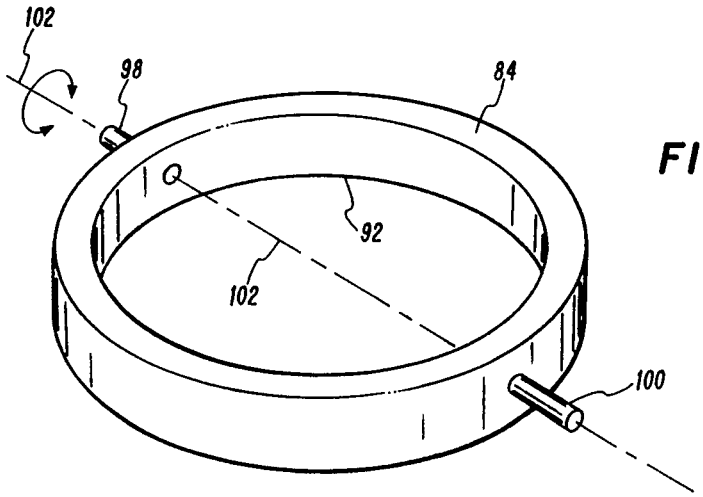
FIG. 6 is a perspective view of the upper clamping ring shown in FIG. 5.
Figure 7:
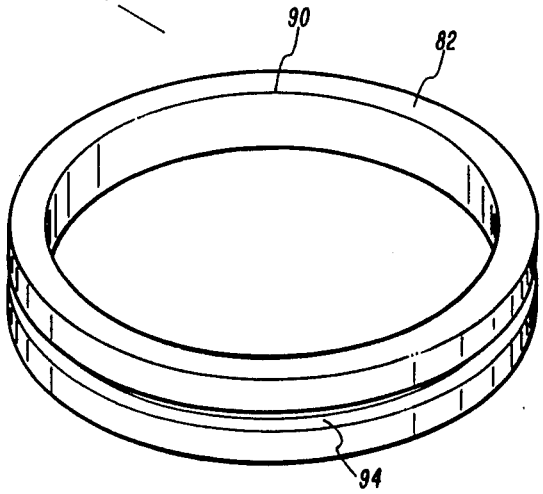
FIG. 7 is a perspective view of the lower clamping ring shown in FIG. 5; and, FIG. 8 is a perspective view of a ball positioning member.

The upper bearing ring 84 is pivotedly attached to the upper clamp block 64 by a pair of pivot pins 98, 100. According to this arrangement, the upper bearing ring 84 is rotatable about the axis 102 within the counterbore 88. The pivot pins 98, 100 are rotatably received within cylindrical bores of upper clamp block 64 and are rigidly attached to the bearing ring 84 along the axis 102 on opposite sides thereof. According to this arrangement, the upper bearing ring 84 deflects and rotates slightly as the upper clamp block 64 is rotated downwardly into the closed position as shown in FIG. 5, thereby allowing the upper bearing ring to seat uniformly and firmly in circular, line contact engagement with the spherical surface of bearing member 58. Moreover, the pivotal coupling of the bearing ring 84 to the upper clamp block 64 allows it to deflect slightly to obtain a clean release and disengagement from the spherical bearing member as the upper clamp block 64 is rotated outwardly when it is desired to release the locking engagement and reset the position of the support shaft 56.

Figure 3:
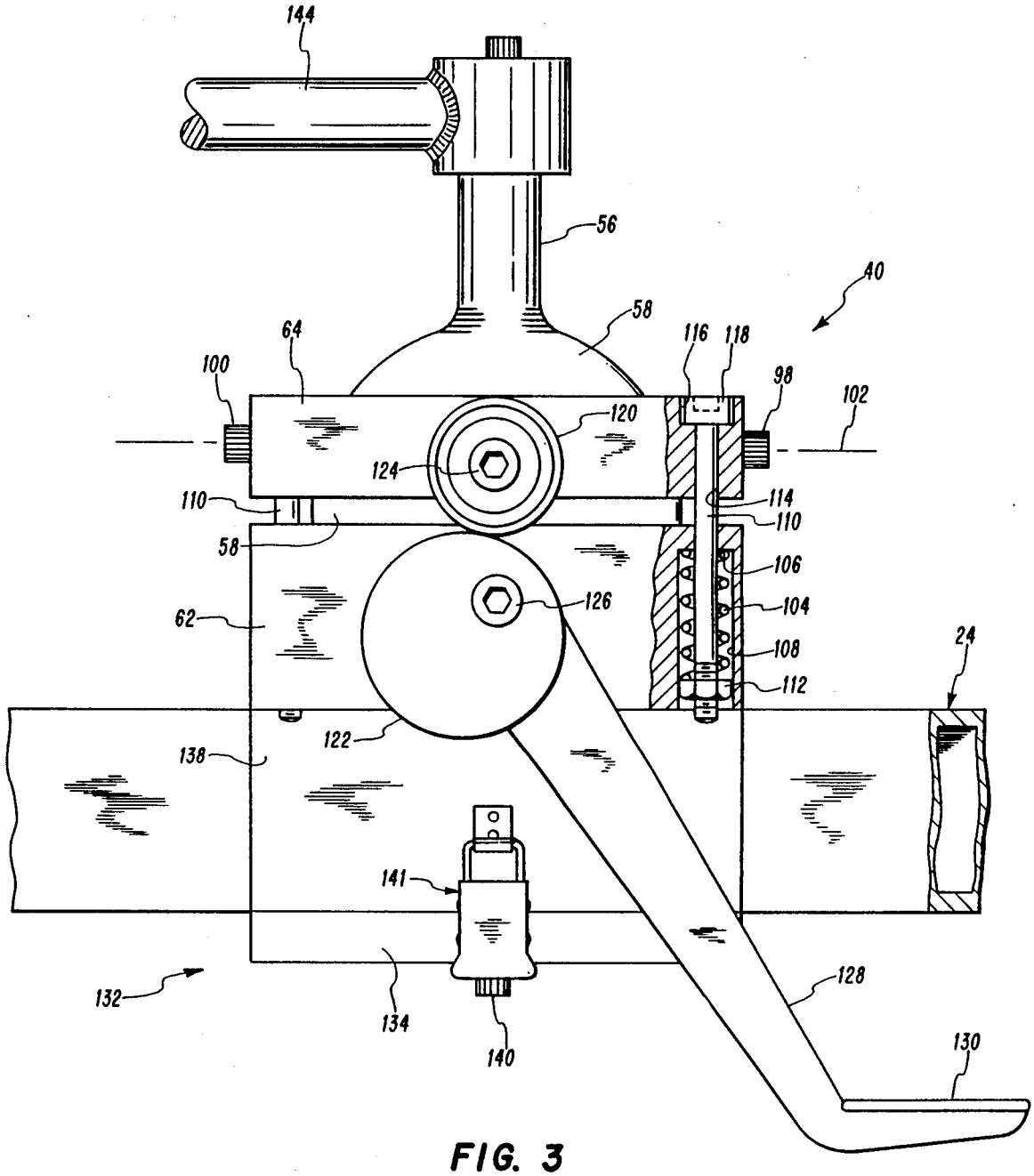
FIG. 3 is a front elevational view, partly in section, of a universal positioning apparatus mounted onto a support bar.

Referring now to FIGS. 3 and 5, the lower and upper clamp blocks 62, 64 are biased toward each other in the closed position by a compression spring 104 which is received within an open bore 106 in the lower clamp block 62. The open bore 106 is enlarged by a counterbore 108, in which the compression spring 104 is confined by a threaded bolt fastener 110 and nut 112. The upper end of the threaded bolt fastener 110 is received within an open bore 114 formed through the upper clamp block 64. The upper end of the open bore 114 is enlarged by counterbore 116 in which the head 118 of the bolt 110 is received. According to this arrangement, the underside of the bolt head 118 bears against the shoulder formed by the counterbore 116, and the compression spring 104 bears against the shoulder formed in the lower clamp block by the counter bore 108. The upper clamp block 64 is resiliently coupled to the lower clamp block 62 by the foregoing fastener bolt and compression spring arrangement at each corner of the universal positioner assembly 40.

The overall biasing force which urges the clamp blocks 62, 64 toward each other may be adjusted by turning the bolt fasteners 110 to vary the deflection of the compression spring 104.

The upper clamp block 64 is provided with a cam follower 120 engaged by a cam roller 122 mounted for rotation on the lower clamp block 62. The cam follower 120 is mounted for rotation on a pin 124 and the cam roller 122 is mounted for offcenter rotation on a pin 126 which projects from the lower clamp block 62. A release lever 128 is rigidly attached to the cam roller 122 and includes a foot pedal 130 which is suspended at a convenient elevation near the floor.

According to the foregoing bias arrangement, when it is desired to reposition the sling assembly 42 or any other such equipment supported by the universal positioner 40, the foot pedal is depressed and the upper clamp block 64 is released and is driven in counter-clockwise rotation as the cam roller 122 turns about the pivot pin 126, thereby displacing the cam follower 120 in the counter-clockwise direction. The gripping action provided by the upper bearing ring 84 is immediately released, and the spherical bearing member 58 may be rotated as desired in any direction. When the desired orientation for the support shaft 56 and its associated equipment has been obtained, the foot pedal is then released, whereupon the compression springs 104 drive the upper clamp block 64 in downward, clockwise rotation toward the lower clamp block 62 until the closed, locked position is established, as illustrated in FIGS. 3 and 5. The foot pedal lies below and outside of the sterile field, so that it can be operated and the sling or other equipment can be repositioned without compromising the sterile condition of the operating table.

Figure 4:
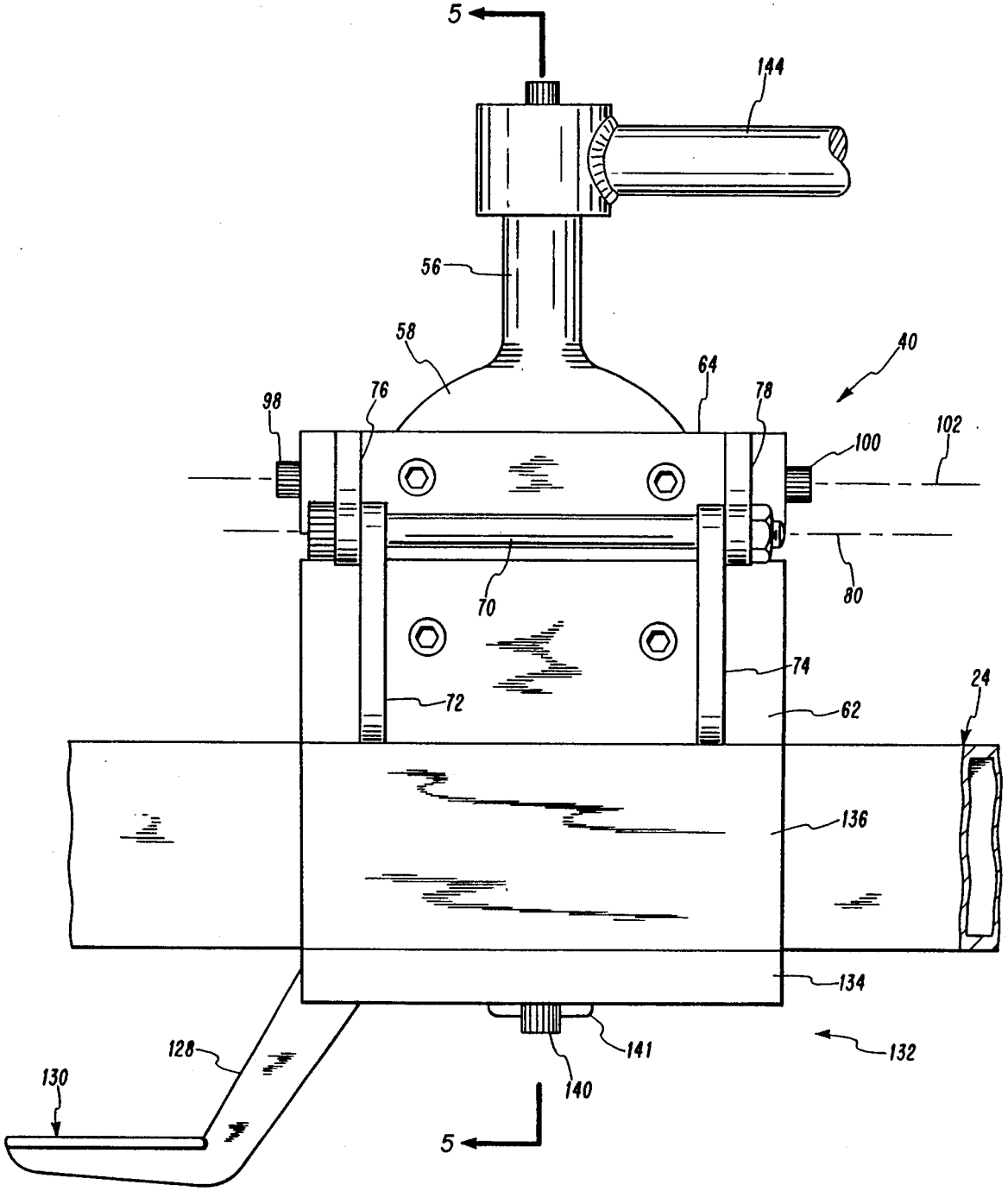
FIG. 4 is a rear elevational view of the universal positioning apparatus shown in FIG. 3.

Referring now to FIGS. 3, 4 and 5, it will be seen that the horizontal support bar 24 is supported in offset relation with respect to the side rail 18 by the vertical struts 26, 28. Because of the triangular brace effect provided by the vertical struts 26, 28, the transverse struts 36, 38 and the operating table 12, the support bar 24 provides a stable, rigid platform for the universal positioner 40 below and outside the sterile operating field. Preferably, the universal positioner 40 is slidable along the support bar 24 so that its position relative to the patient can be adjusted as desired. In this regard, the universal positioner 40 is slidably coupled and clamped onto the support bar 24 by a box clamp assembly 132. The box clamp assembly 132 includes a removable bottom plate 134, a front plate 136 and a rear plate 138. The front and rear plates 136, 138 are secured onto the underside of the lower clamp block 62 by a weld, bolt or the like. The removable bottom plate 134 is attached to the front and rear plates by a threaded screw fastener 140 and a quick release fastener 141.

The universal positioner 40 may be installed onto or removed from the horizontal support bar 24 by first removing the bottom plate 134 from the box clamp assembly 132. The bottom plate 134 is released by removal of the threaded screw fastener 140 and disengagement of the quick release fastener 141. With the bottom plate 134 completely removed, the box clamp assembly 132 can be fitted over the top of the horizontal support bar 24, with the universal positioner riding on top thereof, and with the front plate 136 and rear plate 138 being disposed in slidable, surface-to-surface engagement with the front and rear sidewalls of the horizontal support bar 24. According to this arrangement, the universal positioner 40 can be located as desired along the horizontal support bar. After a desired location has been established, the location is fixed by attaching the bottom plate 134 to the under side of the box clamp assembly 132 by the screw fastener 140 and by the quick release fastener 141. As the screw fastener 140 is tightened and as the fastener 141 is latched as shown in FIG. 5, the lower clamp plate 134 is drawn into compressive engagement with the bottom surface of the horizontal support bar 24.

When it is desired to relocate the positioner along the support bar 24, the quick release fastener 141 is released, and the entire positioner assembly 40 is displaced along the support bar 24 until the new location has been reached. The entire assembly, including the attached sling apparatus, is ready for use as soon as the quick release fastener 141 has been tightened.

It will be appreciated that the universal positioner 40 can be operated to allow the spherical bearing member 58, and the arm 56 connected thereto, to be universally positioned in a predetermined orientation by urging the clamp blocks 62, 64 away from each other sufficiently to release the grip of the annular edges 90, 92. Accordingly, by rotation of the lever arm 128 downwardly, the cam follower 122 and cam roller 120 cause the upper clamp block 64 to rotate and thereby relieve the clamping force acting upon the spherical bearing member 58, whereby it may be rotated at will. Upon release of the clamping force which is provided by the compression springs 104, and as a result of deflection of the upper bearing ring 84, all compressive forces acting upon the spherical bearing member are released, and the spherical bearing member becomes unseated whereby it can be rotated as desired about the axis of the support shaft 56 and whereby it can be inclined as desired to accommodate a new orientation for the sling apparatus.

Therefore, the universal positioning apparatus 40 can be operated at will by a surgeon or support personnel to allow the spherical bearing member 58 and the support shaft 56 to be adjusted in position during the performance of a surgical procedure. Moreover, the positioning apparatus 40 enables operating personnel to control the position of the support shaft 56 without touching the sterile sling apparatus during surgery thereby preserving the sterile conditions. Moreover, during some delicate procedures, the universal positioner 40 allows the surgeon to provide very fine adjustment of the position of the support shaft 56 or of a biasing force transmitted to the patient by the support shaft.

Figure 8:
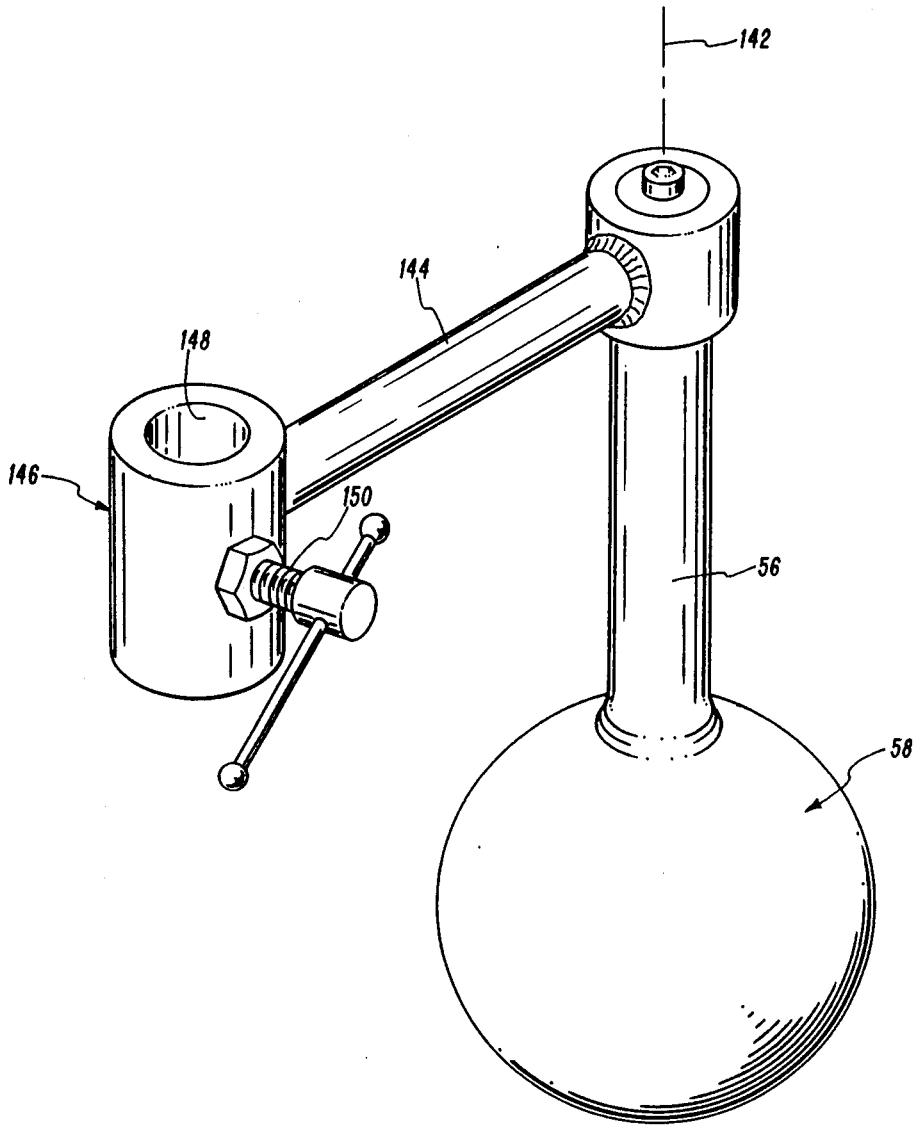

Referring now to FIGS. 5 and 8, it will be apparent that the spherical bearing member 58 can be rotated in azimuth about the axis 142 and can also be rotated in pitch about any axis which is perpendicular to the longitudinal axis 142.

Although the vertical support arms 26, 28 together with the rail clamps 34 provide some lateral offset effect, varying degrees of lateral offset support may be required which exceed the fixed amount of lateral displacement provided by the side rail support structure. Accordingly, a lateral offset arm 144 is rigidly secured to the support shaft 56 in transverse relation with respect to the longitudinal axis 142, and preferably at a right angle thereto. A cylindrical coupling sleeve 146 is rigidly attached to the distal end of the lateral offset arm 144. The coupling sleeve 146 is provided with a cylindrical bore 148 in which the sling assembly support shaft 50 is slidably received. The position of the shaft 50 within the coupling sleeve 146 is fixed by a threaded turn screw 150 which may be advanced into the bore 148 and into engagement with the shaft 50 by rotation of the turn screw 150.

It will be appreciated that any combination of positioning apparatus, including multiple positioners 40, may be used in predetermined spaced relationship with respect to each other along the support bar 24 for positioning a plurality of patient support apparatus such as the sling assembly 44. Normally, for positioning a patient extremity or a portion thereof in a position which is not likely to be changed during a surgical procedure, the universal positioning apparatus 40 will be used and preset in a fixed position along the support bar 22. For positioning an extremity which is likely to undergo a position change or to undergo a change in biasing force acting thereon during treatment, it is preferred to use a rail clamp assembly which can be quickly and easily released so that the location of the universal positioner along the support rail 24 can be quickly and easily re-established.

Although a preferred embodiment of the invention has been disclosed and detailed, it will be understood that various substitutions and modifications may be made to the preferred embodiment without departing from the scope and spirit of the invention as defined by the appended claims.

What is claimed is:

1. Apparatus for positioning a patient extremity in a predetermined position relative to the sterile zone of an operating table during a surgical procedure, said apparatus comprising:

(a) clamping apparatus including (1) a first member comprising a generally spherical ball, (2) a second member comprising a pair of opposed blocks, each block having a socket for receiving a portion of the spherical ball and an annular edge formed on each socket for gripping said ball substantially in line contact engagement, (3) means for yieldably biasing said blocks toward each other for forceable engagement of said annular edges against said ball to retain said blocks and said ball in a predetermined position with respect to each other, said first and second members forming a coupling between said arm and said support means, (4) release means for releasing said annular edges and said ball from said forceable engagement, and said release means comprising means for moving one of said blocks relative to the other of said blocks to reduce the biasing force acting on said ball;

(b) suspension means for attaching said clamping apparatus to an operating table including a bracket connected to one of said blocks; and, (c) an elongated support arm connected to said spherical ball for holding patient support apparatus at an elevated position over the operating table.

2. Positioning apparatus for positioning a patient extremity in a predetermined position during a surgical procedure, positioning apparatus comprising:

(a) mechanism connected to an elongated support arm and supported by support means connected to an operating table or the like, said mechanism including (1) a first member comprising a generally spherical ball, (2) a second member comprising a pair of opposed blocks, each block having portions defining a pocket for receiving a portion of said spherical ball and having an annular edge formed on said socket for gripping said ball substantially in line contact engagement, (3) means for yieldably biasing said blocks toward each other for foreceable engagement of said annular edges against said ball to retain said blocks and said ball in a predetermined position with respect to each other, and (4) release means for releasing said blocks and ball from said foreceable engagement, said release means comprising means for moving one of said blocks relative to the other of said blocks to reduce the biasing force acting on said ball; and (b) said support arm including a base portion connected to said ball, said base portion having a generally vertically extending tubular part, and a second part of said arm telescopingly insertable in said tubular part of said base portion, said second part extending generally above a patient support surface on said table.

3. Positioning apparatus for supporting and maintaining a predetermined position of a patient extremity during a surgical procedure, said positioning apparatus comprising:

an elongate bar mounted to said table generally below the patient support surface of said table and slightly above the floor;

an arm extendable generally above the patient support surface of said table;

universal connecting means mounted on said elongate bar for universal positioning of said arm relative to said bar, said universal connecting means including first and second gripping members and a connecting member engaging said arm and said gripping members, each gripping member having an annular edge, and said universal connecting means being operable to position said arm within a range determined substantially by limit position of said connecting means;

resilient biasing means mounted with said universal connecting means for biasing the annular edges of said first and second gripping members into compressive, line contact engagement with said interconnecting member for retaining said arm in a predetermined position relative to said bar; and bias releasing means mounted with said universal connecting means for selectively releasing compressive engagement of said first and second annular gripping members sufficiently to permit movement of said arm relative to said bar.

4. Apparatus for positioning a patient extremity in a predetermined position during a medical or surgical procedure, said positioning apparatus adapted for attachment to an operating table or the like, said positioning apparatus comprising:

a coupling device adapted for attachment to said operating table generally below the patient support surface of said operating table;

universal connecting means comprising first and second connecting members, said first connecting member being mounted with saisd coupling device, said second connecting member including a generally spherical ball and having an arm connected thereto, said second connecting member adapted to engage said first connecting member for universal positioning of said arm relative to said first connecting member within a range determined substantially by limit positions of said first connecting member, and said first connecting member having a pair of opposed housings, each housing have a generally circular jaw and an annular edge formed on the jaw for gripping said ball substantially in line contact engagement to retain said ball in position relative to said opposed housings;

resilient biasing means mounted with said universal connecting means for biasing said first and second connecting members into forcible engagement with each other for retaining said arm in a predetermined position relative to said attachment device; and bias releasing means mounted with said universal connecting means for selectively releasing said forcible engagement of said first and second connecting members sufficiently to permit movement of said arm relative to said attachment device.

5. The apparatus as set forth in claim 4, wherein one of said circular jaws is movably mounted on its respective housing in a manner to be adjustable relative to said other one of said circular jaws in a manner to align itself relative to said other circular jaw about said ball.

6. The apparatus as set forth in claim 4, wherein said pair of opposed housings are pivotally coupled together in a manner to open and essentially close together about said ball, and wherein one of said housings includes and open passageway therein for receiving said arm therethrough.

7. The apparatus as set forth in claim 4, wherein said resilient biasing means comprises a compression spring mounted with said first connecting member for urging said pair of opposed housings toward each other to enable said jaws to engage said ball.

8. The apparatus as set forth in claim 7, wherein said bias releasing means comprises means for separating said pair of opposed housings sufficiently to disengage said jaws from said ball to permit movement of said ball relative to said jaws.

9. An apparatus for attachment to a surgical operating table or the like for supporting a patient during surgery, comprising:

an elongated bar suspended from said table generally below the patient support surface of said table;

an arm extendable above said patient support surface and connectable to means for supporting a patient extremity; and positioning means mounted on said bar and including a ball member interconnecting said arm and said positioning means, said positioning means including first and second rings, each ring having an annular edge for engaging said ball, and resilient bias means urging said rings into engagement with said ball member, said positioning means being operable to position said arm within a range determined substantially by limit positions of said positioning means whereby the position of an extremity supported on said arm may be altered.

10. The apparatus set forth in claim 9 wherein:

said bar is supported on said table by a pair of spaced apart legs, each leg including at one end releasable clamp means connected to support means on one side of said table, and each leg being connected at its opposite end to bracket means connected to said bar.

11. The apparatus set forth in claim 10 wherein:

said apparatus including struts each connected at one end, respectively, to each of said bracket means and extending generally upward to the side of said table opposite said one side, said struts each including releasable clamp means for connecting opposite ends of said struts to support means on said opposite side of said table.

12. The apparatus as set forth in claim 9, said positioning means including first and second housings, and said first and second ring being received in said first and second housings, one of said rings being mounted for rotation within its respective housing, said one ring having an annular groove, and said respective housing having a retaining pin, said retaining pin being received within said annular groove for permitting rotation of said ring with respect to said housing while limiting axial displacement of said ring.

* * * * *